US007404488B2

(12) United States Patent
Verbruggen et al.

(10) Patent No.: US 7,404,488 B2
(45) Date of Patent: Jul. 29, 2008

(54) PREMIUM PACKAGING

(75) Inventors: Antonius Cornelius Verbruggen, Haarlem (NL); Marco Bakker, Amsterdam (NL); Mary Aiken, Dublin (IE)

(73) Assignee: Logistix Limited, Buckinghamshire (GB)

( * ) Notice: Subject to any disclaimer, the term of this patent is extended or adjusted under 35 U.S.C. 154(b) by 0 days.

(21) Appl. No.: 10/531,625

(22) PCT Filed: Oct. 3, 2003

(86) PCT No.: PCT/GB03/04264

§ 371 (c)(1),
(2), (4) Date: Jan. 11, 2006

(87) PCT Pub. No.: WO2004/035398

PCT Pub. Date: Apr. 29, 2004

(65) Prior Publication Data

US 2006/0243608 A1 Nov. 2, 2006

(30) Foreign Application Priority Data

Oct. 14, 2002 (GB) ..... 0223901.0

(51) Int. Cl.
*B65D 73/00* (2006.01)

(52) U.S. Cl. ..... 206/484; 206/216; 206/232

(58) Field of Classification Search ..... 206/38, 206/216, 232, 449, 472, 473, 484; 40/124.191
See application file for complete search history.

(56) References Cited

U.S. PATENT DOCUMENTS 5,161,688 A 11/1992 Muchin
5,270,101 A * 12/1993 Helicher ..... 428/209

(Continued)

FOREIGN PATENT DOCUMENTS

DE 4 020 089 C1 6/1990

(Continued)

*Primary Examiner*—David T Fidei
(74) *Attorney, Agent, or Firm*—Stephen B. Salai, Esq.; Michael J. Didas, Esq.; Harter Secrest & Emery LLP

(57) ABSTRACT

In packaging 10 comprising three layers of material 14, 16, 18 adhered together, the middle layer 16 has at east one portion 20 removed, defining a void inside the packaging. The three layers are the same size and shape. Partial cut-lines 22 extend width layers through all layers, at the edge of the packaging, to aid opening. A further perforation 32 may be applied to the two outer layers, substantially bridging the gap between the outer cuts. The first layer of the packaging is initially not completely joined to the middle layer, and can be folded back about a fold line 44, to allow insertion of an object before closing. A tapered gap 56 maybe provided in the edge of the middle layer, connecting to the removed portion. One of the outer layers 14, 18 may be provided with a printed, perforated portion, overlying the void space in the middle layer. A method of producing said packaging comprises removing at least a portion from one of three layers, and laminating or bonding the layers together with said altered layer in the middle. The three layers may be provided as a single blank, and folded to position them on top of one another, the blank being pre-cut with the removed portion of the middle layer.

18 Claims, 4 Drawing Sheets

U.S. PATENT DOCUMENTS 5,282,651 A * 2/1994 Alonso ..... 283/117
5,287,641 A * 2/1994 Showers ..... 40/488
6,058,640 A * 5/2000 Young ..... 40/709
6,125,564 A * 10/2000 Young ..... 40/427
6,186,327 B1 * 2/2001 Hadden ..... 206/472
6,691,872 B1 * 2/2004 Berman et al. ..... 206/484
2003/0080016 A1 * 5/2003 Lipper ..... 206/459.5

FOREIGN PATENT DOCUMENTS

FR 2 791 326 A1 9/2000
GB 2 394 213 A 10/2002

* cited by examiner

Alternative I
*(Upper end is left open for insertion of premium by hand)*

Alternative II
*(With "lobster pot")*

PREMIUM PACKAGING

CROSS REFERENCE TO RELATED APPLICATIONS

This application claims priority from GB0223901.0, the whole contents of which are incorporated herein by way of reference.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION BY REFERENCE OF MATERIAL SUBMITTED ON A COMPACT DISC

Not applicable.

BACKGROUND OF THE INVENTION (1) Field of the invention

The present invention relates to a premium packaging, in particular a packaging or packaging system for packaging printed promotional items that are used by food suppliers or packagers as inserts for accompanying their food products in the food packaging.

(2) Description of Related Art including information disclosed under 37 CFR 1.97 and 1.98

It is common practice to package inserts such as premium items within the packaging of a food product. For example, in the breakfast cereal industry promotional and premium items are often added as an insert with the cereal, typically within the sealed bag that contains the cereal. However, packaging such inserts with food products runs the risk of tainting the flavour, or appearance, e.g. colour, of the food product. This is not only undesirable but may also be unacceptable under food quality regulations. Accordingly, promotional or premium items, or other inserts, currently are wrapped in a food safe packaging in order to keep them separated from the food products. Until recently, this has typically been done by using an oil based film often called a flow-wrap. Flow-wrapping is expensive and can cost the same as the premium item or insert itself. It has the advantage, however, of being available in an odour barrier-form which prevents food from being tainted by any residual odours attributable, for example, to the printing inks. It will also generally be impervious to prevent the inks from running or staining the food.

The flow-wrap typically has a solely functional purpose, although the flow-wrap material can be printed or coloured. Flow-wrap material is not substantial (it is a thin film) and lacks any value-adding merit in its own right, save for its protective function. The invention is designed to achieve this protective function, but in addition to represent something which is attractive, interesting and has a promotional or game-play purpose.

In the snack foods sector, there has been a move towards flow-wrapping premium items in paper, i.e. between two layers of paper. This is substantially cheaper than oil based film. However, it cannot be used for three dimensional items, i.e. items thicker than a nominal thickness. Further, there is a risk of odours or colours passing through the paper to taint the food. However, the risk of tainting the food can be mitigated by using premium inserts which either carry a minimal odour or a good colourfast quality. Alternatively, for example in the case of cereal products, the premium item can be inserted in its paper flow-wrapping into the food packaging between the food wrapper and the cardboard outer packaging.

If attempting to flow-wrap a three dimensional premium item in paper, the paper packaging will typically crease or fold in an unsightly manner upon packaging the premium item. It would therefore be desirable to provide a new packaging or packaging system, and a method of packaging, for premium items for use in the food industry.

BRIEF SUMMARY OF THE INVENTION

According to the present invention, there is provided a packaging for a premium item comprising three layers of material, a first layer and a second layer being laminated to one another and having co-terminal peripheries, wherein the second layer has at least one portion thereof removed, the third layer being laminated to the opposite side of the second layer to the first layer. This defines a packaging have a central void therein defined by the removed portion for receiving the premium item therein. Preferably, the third layer also has a co-terminal periphery to the first and second layers. The second layer has a thickness that depends upon the thickness of the premium item to be inserted into the void. Its thickness defines the depth of the void into which the premium item will be placed. Generally speaking, however, its thickness will be substantially the same as the first and third layers since the premium items tend to be made of card as well.

If the premium item is very thin or very small, then a simpler solution would be to spot glue the premium item to one panel of a two panel card, fold one panel over the other panel and seal them together.

Preferably, the materials are food-safe materials. By food-safe, it is meant either an odour free or colourfast material. For a non-colourfast material, any dye or ink used for colouring the material would need to be an edible dye. For a non-odour free material, the odour would need to be palatable. Food-safe also suggests that there is no metallic content in the material.

Preferably the removed portion is a central portion.

Preferably the packaging is a snap-apart packaging having partial cut lines extending across the width of the packaging to allow a first section of the packaging to be snapped away from the second section of the packaging. Preferably the packaging snaps substantially in half.

Preferably a premium item is sealed within the void of the packaging. Preferably the void corresponds substantially to the shape of the premium item. The premium item may have a nominal thickness i.e. it may be a substantially flat item, such as a trading card or collecting card.

Each layer may itself be layered, i.e. the packaging may be formed using multi-layered materials or laminates.

Preferably, a section of the first or the third layer is not initially laminated to the second layer. This allows the section of the first or the third layer to be separable from the second layer to access the void. This allows a premium item to be inserted into the void. The packaging therefore acts like an envelope. Preferably, this section of the first or third layer is bounded by edges of the packaging and a fold line extending across the width of the packaging; the fold line assists a user in opening the envelope to access the void.

Preferably, cuts for defining a snap-apart section are provided by two co-planar outer cuts, in or immediately adjacent to the side edges of the packaging, the cuts extending through the three layers of the packaging, and a third cut, just in the first and third layers substantially bridging the gap between the two outer cuts. The cuts may be perforations. Preferably, uncut portions separate the third cut from the outer cuts. Preferably, uncut portions separate the outer cuts from the very edges of the packaging.

Preferably, at least some of the cuts or perforations are provided in the layers before laminating the layers together.

The third layer may comprise a wall of a cardboard packaging, e.g. of a food product, the first and second layers being attached to the inside of the wall of the cardboard packaging to form the packaging within the cardboard packaging.

The second layer may have a gap provided in one of its edge portions extending from the edge to the removed portion. This provides a slot for accessing the void in the envelope upon laminating the second layer between the first and third layers. The slot can be permanently open. It could, however, be glued shut after inserting a premium item into the void through the slot.

The gap can be tapered so that the slot will facilitate the inserting of a premium item into the envelope. Preferably, the slot has an outer width and an inner width, the outer width being wider than the premium item to be inserted into the envelope and the inner width being of a substantially similar width to the premium item to be inserted into the envelope. In this manner, the premium item can easily be inserted into the envelope but will be difficult to shake out of the envelope. A packaging of this form thereby operates in a similar fashion to a lobster pot.

The first or the third layer may comprise at least one perforated portion that overlies the portion of the second layer that has been removed. This perforated portion enables access to a premium item in the void to be obtained by ripping out the perforated portion. Preferably, the perforated portion is larger than the premium item so that the premium item can be removed from the void upon ripping out the perforated portion.

The perforated portion may be the same size as the removed portion of the second layer. However, preferably it is smaller than the removed portion of the second layer.

The perforated portion may itself be printed so that it forms an additional premium item or trading card upon removing it from the packaging.

The first or third layer may have a thumb-sized cut-out provided in an edge thereof, preferably overlying the slot or an unglued portion of the packaging. This provides a grip for a user. Using the grip he can either access a premium item by delaminating the packaging or he can insert a premium item into the void by opening up the slot or unglued portion a little bit; a fingernail can more easily be inserted between the layers of the packaging as a result of the provision of this cut-out.

Instead of snapping apart the packaging, or delaminating the packaging, a user may tear off an edge of the packaging to access the premium item, thereby accessing the void and the premium item contained therein.

The first or third layer may have an aperture therein for accessing the void. A premium item may then be slotted through the aperture into the void.

According to a second aspect of the present invention, there is provided a method of packaging a premium item comprising the steps of providing three layers of material for laminating over each other, removing at least a portion of middle one of the three layers, and laminating the three layers together to create a packaging having a void in the middle thereof defined by the portion of the middle layer that was removed. The method may comprise the step of applying a bonding agent to at least one of the layers such that the middle layer can be glued to the other two layers between the two other layers.

Preferably, a portion of the periphery of the packaging is initially unglued to provide an access point for insertion of a premium item into the void of the packaging defined by the removed portion of the middle layer. The method may then comprise the steps of inserting a premium item into the void and, once inserted, gluing the unglued portion shut.

An edge portion of the middle layer may be cut away down to the removed portion to form a gap. In this manner, once the layers are laminated together, the edge of the packaging has an open slot for accessing the void within the packaging for insertion of a premium item therein.

The packaging formed with the above method may be in accordance with the first aspect of the present invention.

The method may comprise providing the three layers as a single blank and folding the blank to position the three layers on top of one another. The or each packaging may then need to be cut out of the folded blank.

The blank may be pre-cut with apertures corresponding to the removed portions of the middle layer. Die cuts corresponding to the perforations in the finished product may also be provided in the blank.

Multiple packagings may be manufactured in this manner, for example by providing an array of cut outs and/or perforations in the blank. The finished packagings may then be cut from the folded blank by an automated die cutting or stamping machine. The machine is preferably an automated die cutting, gluing and folding machine that completes the whole manufacturing process.

The present invention also provides a blank for use in the above described method.

Preferably, the packagings so formed may be glued to the inside of a cardboard packaging, for example a cardboard packaging for a food product such as a cereal packet.

The present invention also provides a packaging for a premium item comprising three layers of material, a first layer and a second layer being laminated to one another and having co-terminal peripheries, wherein the second layer has at least one portion thereof removed for defining a void inside the packaging, the third layer being laminated to the opposite side of the second layer to the first layer; wherein a section of the first or the third layer is not initially laminated to the second layer, the section defining a foldable flap for defining an access point for the void for insertion of a premium item into the void.

The present invention also provides a method of packaging a premium item comprising the steps of providing three layers of material for laminating over each other, removing at least a portion of the middle one of the three layers, and laminating the three layers together to create a packaging having a void in the middle thereof defined by the portion of the middle layer that was removed; wherein a portion of the periphery of the packaging is initially unglued to provide an access point for insertion, after lamination, of a premium item into the void of the packaging defined by the removed portion of the middle layer.

The present invention also provides a method of packaging a premium item comprising the steps of providing three layers of material for laminating over each other, removing at least a portion of the middle one of the three layers, and laminating the three layers together to create a packaging having a void in the middle thereof defined by the portion of the middle layer that was removed comprising the steps of providing the three layers as a single blank and folding the blank to position the three layers on top of one another.

A skilled person will also readily appreciate that features of one aspect of the invention may beneficially be combined with features of other aspects of the invention to arrive at alternative embodiments.

BRIEF DESCRIPTION OF THE SEVERAL VIEWS OF THE DRAWING(S)

These and other aspects of the present invention will now be described by way of example with reference to the accompanying drawings in which.

DETAILED DESCRIPTION OF THE INVENTION

Figure 1:
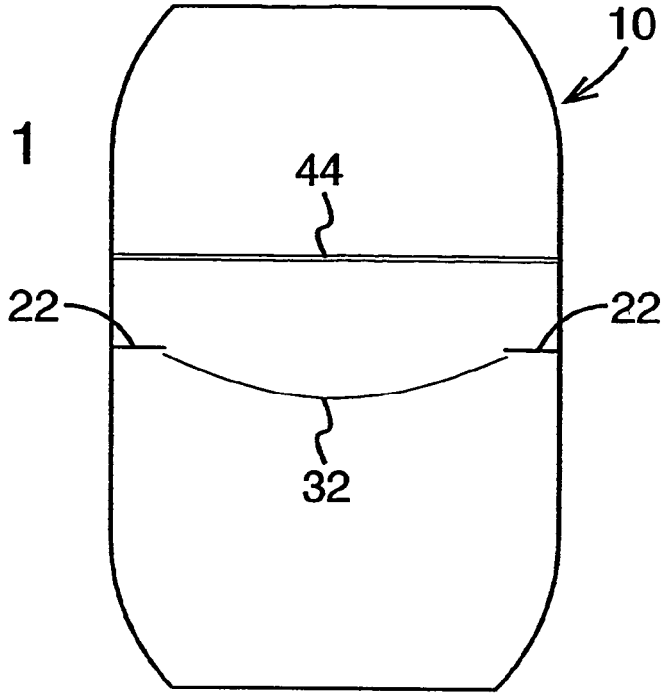
FIG. 1 shows a preferred embodiment of a snap-apart packaging having a fold line provided thereon.
Figure 2:
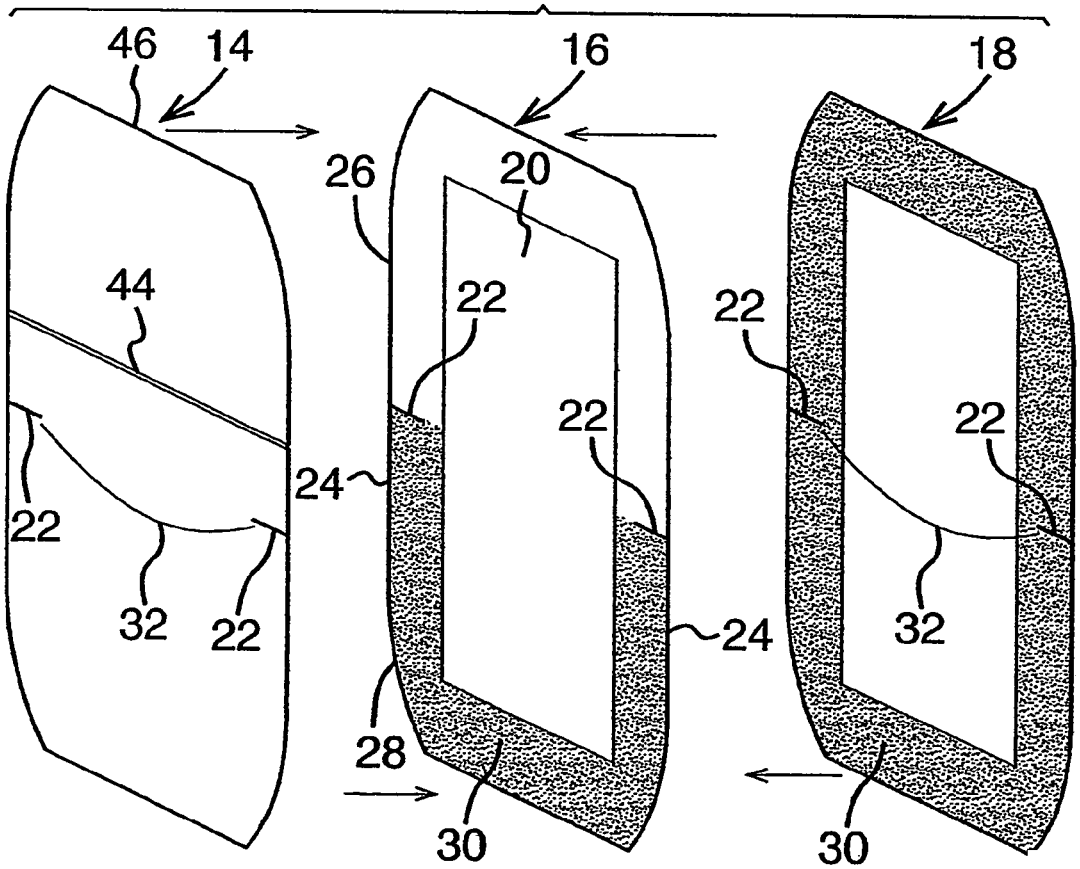
FIG. 2 is a exploded view of the three layers used in forming the packaging of FIG. 1.

Referring now to FIGS. 1 and 2, a packaging 10 for a premium item 12 (see FIG. 5) is shown. As clearly shown in FIG. 2, the packaging 10 comprises three layers 14, 16, 18 each having the same outside shape. This shape is substantially rectangular with rounded corners.

The middle or second layer 16 has a removed portion 20. It also has two slots 22 cut through its sides 24. The slots 22 effectively separate the middle layer 16 into two halves 26, 28. The first half 26 of the middle layer 16 has, initially, no adhesive applied to it. The second half 28 of the middle layer 16 has an adhesive 30 applied on one of its surfaces. This surface will face the first layer 14 of the packaging 10.

The opposite surface (not shown) of the middle layer 16 of the packaging 10 may have adhesive provided thereon over its entire surface. However, this is optional since an adhesive 30 is provided around the edges of the third layer 18 of the packaging 10. This adhesive faces the middle layer 16. Instead of applying the adhesive on both the middle layer 16 and the third layer 18, it would be possible to apply adhesive in some other appropriate manner onto the middle layer or onto the first layer and the third layer such that they can be laminated together.

A fold line 44 is provided in the first layer 14 to overlie the first half 26 of the second layer and to extend across the full width of the first layer 14. This defines a foldable flap 46.

The flap 46 will not initially be glued to the second or middle layer 16 since no adhesive 30 was provided at that part of the middle layer 16. Therefore, the fold line will enable the flap 46 above the fold line 44 to be displaced away from the middle layer 16 of the packaging 10 after the three layers 14, 16, 18 have been laminated together. This enables access to the removed portion 20 to be gained after lamination. The removed portion 20 provides a void inside the packaging 10 for receiving a premium item 12. The flap 46 thereby allows the premium item to be inserted into the void.

The first layer 14 and the third layer 18 also both have slots 22 in the sides thereof. These slots will align with the slots 22 in the middle layer 16 upon laminating the three layers 14, 16, 18 together. A further slot 32 is provided in both the first layer 14 and the third layer 18 of the packaging 10. This further slot 32 substantially bridges the two slots 22 in the sides of these two layers 14, 18. The combination of all these slots 22, 32 means that upon laminating the three layers together, the slots can be used for providing a frangible cut across the packaging 10 to enable the packaging 10 to be snapped apart to reveal a premium item 12 that was placed in the void.

The slots 22, 32 are preferably provided to extend all the way through the individual layers. However, they may be partial cuts or scores. Alternatively, they may be perforations. Preferably, the cuts do not extend to the extreme sides of the material in the various layers. This enables the layers to retain integrity during the manufacturing process of the packaging 10.

The removed portion 20 is shown to be rectangular. Further, it is in the middle portion of the middle layer 16. It could, however, have other shapes or be positioned non-centrally of the middle layer.

Figure 3:
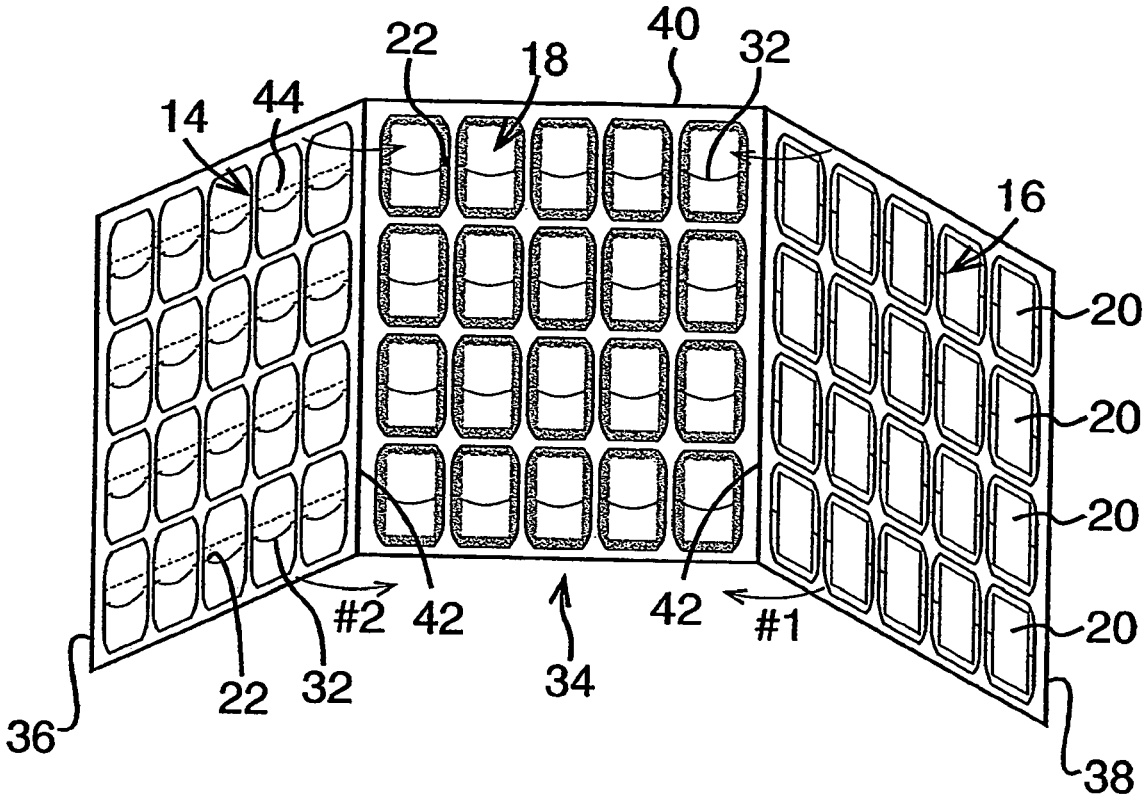
FIG. 3 shows the folding of a blank to form a plurality of packagings.

Referring now to FIG. 3, a blank for forming a plurality of packagings 10 is shown. A plurality of first layers 14 are shown in a first array on a first side fold 36 of the blank 34. A plurality of middle layers 16 are shown in an array in a second side fold 38 of the blank 34. A plurality of third layers 18 is shown in an array in the middle section 40 of the blank 34, between the two side folds 36, 38. Fold lines 42 are provided between the various sections 36, 38, 40 of the blank 34.

Although the whole shape of each of the various layers 14, 16, 18 of a finished packaging are shown in the blank, it may only be necessary to provide some of the details, for example just the removed portions 20 in the middle layers or additionally the slots 22, 32 in the first, second and third layers 14, 16, 18.

If provided, fold lines 34 may also be provided on the blank 34 for the first layers 14.

To form the plurality of packagings 10 using the blank 34, a first fold #1 is completed about its fold line 42 to position second side fold 38 over the middle section 40 of the blank. Appropriately positioned adhesive on the middle section 40, corresponding to that shown in FIG. 2, enables these two layers to be laminated together. Then, the first side fold 36 is folded #2 about its fold line 42 to position that layer over the two previously laminated layers. Again, suitably positioned adhesive will enable the lamination to be completed.

Preferably, the adhesive is provided on only one surface of the blank 34. A number of difference glue positionings could achieve this. A person skilled in the art will readily be able to appreciate the various cuts, perforations, applications of adhesive and folds necessary to produce a set of packagings using blanks of this type.

Figure 4:
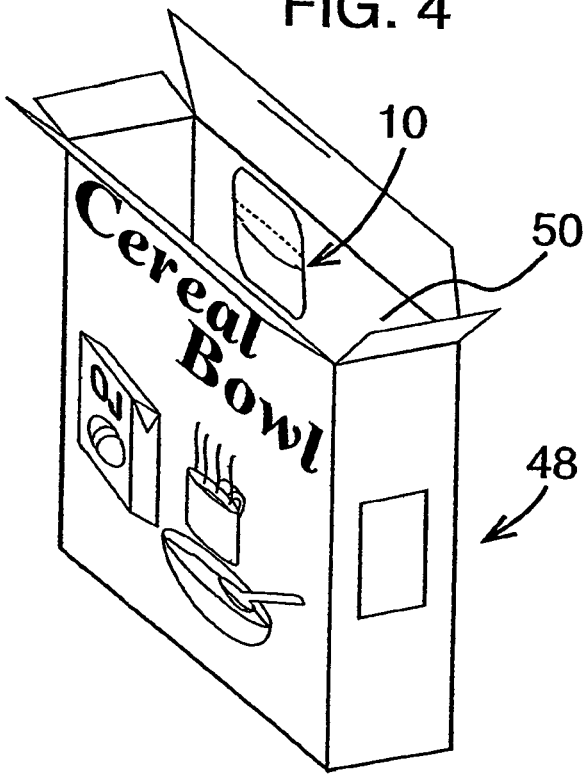
FIG. 4 shows a packaging of the present invention glued on the inside of a cardboard packaging for a food product.

Referring now to FIG. 4, a use for the packagings so formed is shown. A cardboard outer packaging 48 for packaging cereal is provided having a packaging 10 in accordance with the invention glued to an inside back wall 50 of the cardboard outer packaging 48. In this manner, the packaging 10 of the invention will cause no interference to the insertion of the food packaging for containing the cereal (not shown) into the outer cardboard packaging 48.

Figure 5:
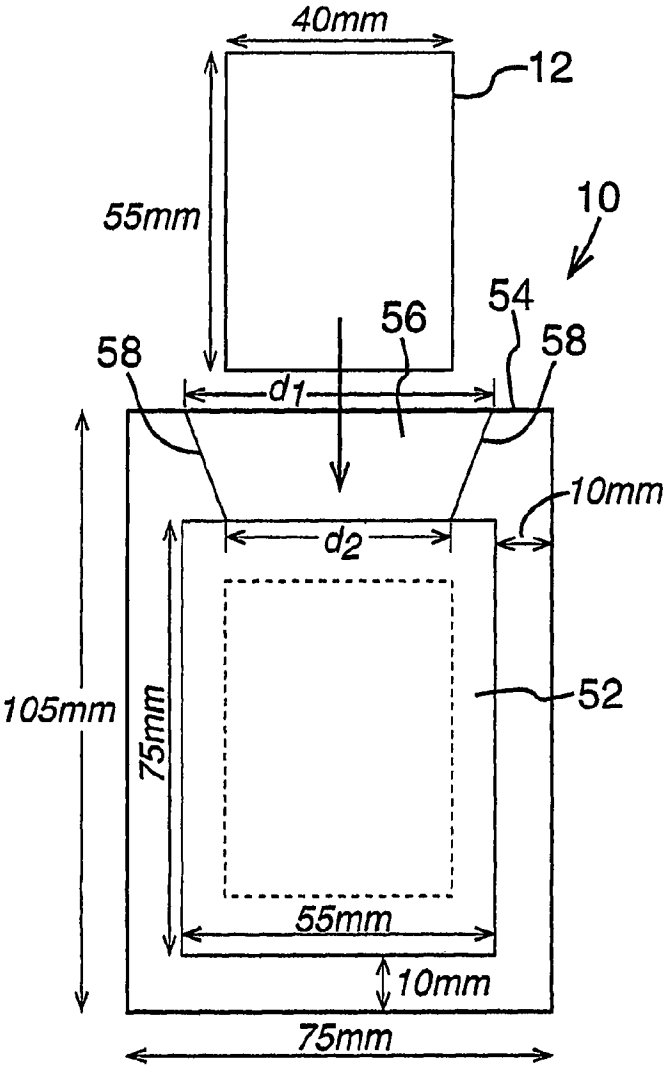
FIG. 5 shows an alternative embodiment of the present invention having a slot for accessing the void inside the packaging.

Referring now to FIG. 5, a variant of the packaging 10 of FIG. 1 is shown. Here, the packaging 10 has a substantially rectangular shape with a substantially rectangular void 52 therein. As can be seen, the void 52 has dimensions of 75 mm by 55 mm. The packaging 10 has dimensions of 105 mm by 75 mm. This gives side wall thicknesses for the packaging 10 of 10 mm.

This packaging 10 is ideal for receiving a premium item 12 having dimensions of 55 mm by 10 mm or more preferably 55 mm by 40 mm.

A top side 54 of the packaging 10 has a gap 56 provided therein. This gap is only formed in the middle layer 16, thereby defining a slot in the edge of the packaging 10. This slot enables the premium item 12 to be slid into the packaging 10 easily after lamination of the various layers as described above with reference to the first embodiment.

As shown in FIG. 5, the gap 56 has tapered sides 58 so that the slot has a wide opening and a more constricted inside dimension. This enables the premium item 12 to be inserted into the slot easily, and yet be difficult to remove from the void 52 via the slot.

Preferably, the dimension $d_1$ of the outside of the slot is approximately 50 mm and the dimension $d_2$ of the inside of the slot is approximately 41 mm. In this manner, a premium item having a width of 40 mm will be unlikely to fall out of the void 52. The inside dimension $d_2$ of the slot may, however, be slightly smaller than the premium item so that the premium item has to be forced into the void. It will then be unable to fall out of the void.

Figure 6:
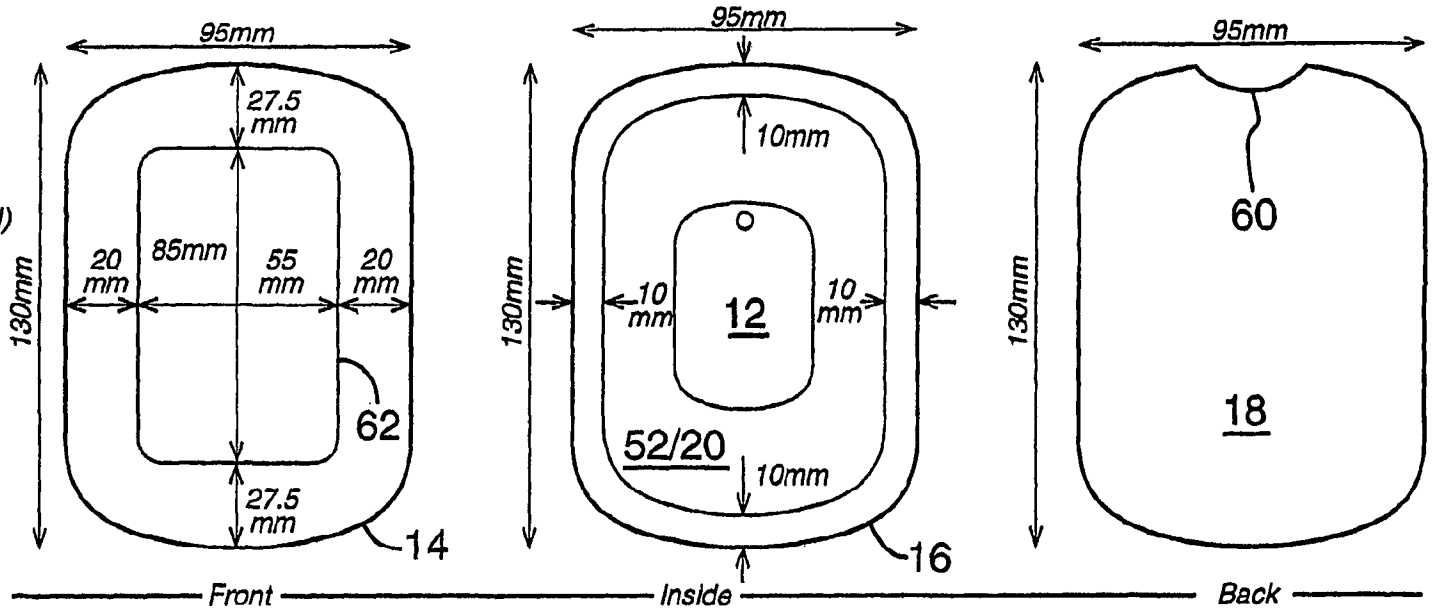
FIG. 6 shows the three layers for making a third embodiment of the present invention having a perforated rip-out portion.
Figure 7:
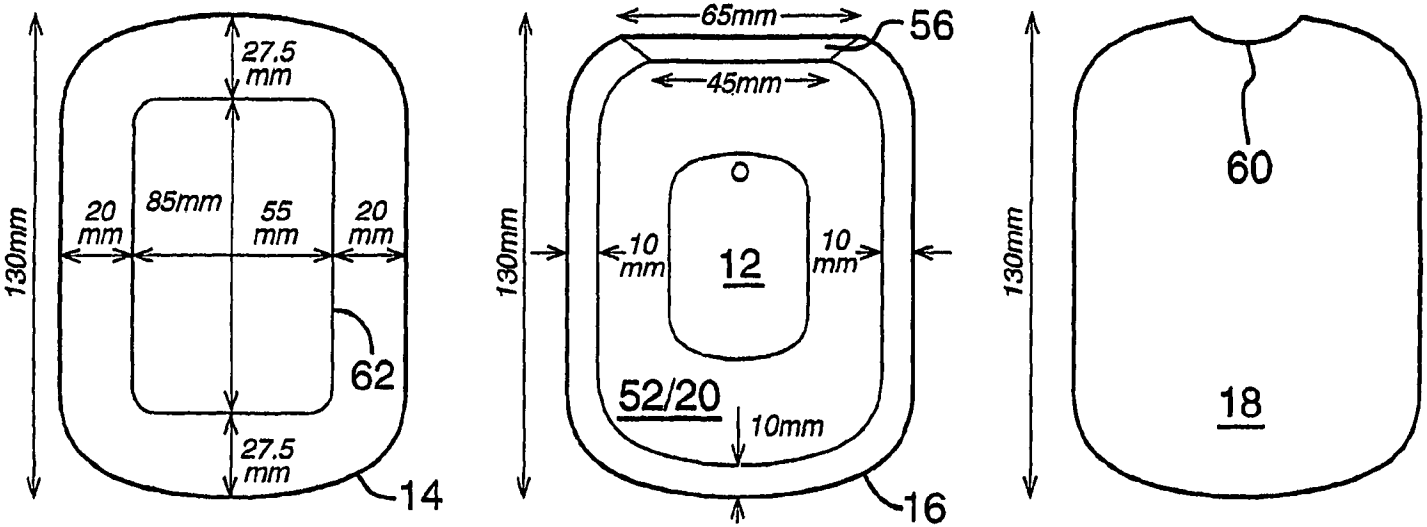
FIG. 7 shows a variant of FIG. 6.

Referring now to FIGS. 6 and 7, two further variants of the packaging 10 are disclosed. In these two embodiments, the outside shape is still substantially rectangular. However, again the corners have been rounded, like in the first embodiment.

In FIG. 6, no gap is provided in the middle layer 14. However, a gap 56 is provided in the middle layer 16 of the embodiments shown in FIG. 7. The gap is to provide the same function as that described above for the embodiment of FIG. 5.

The main differences between these last two embodiments and the previous embodiments in both of these two embodiments are twofold. First of all a thumb sized cut out 60 is provided in each of the third layers 18. These thumb sized cut outs are provided in the top edges of the third layers 18 to enable a finger nail to be used to separate the various layers after lamination. For example, a fingernail could be used to separate the flap 46 shown in the first embodiment from the second and third layers. The fingernail could also be used to widen the slot provided by the gap 56 slightly to assist in the insertion of a premium item 12. The fingernail could also be used to enable the delamination of the various layers for accessing the premium item 12. Secondly each of the first layers 14 is provided with a perforated portion overlying the void 52 or removed portion 20. This perforated portion is cut into the first layer 14 either as a perforated cut or as a partial depth cut. This perforated portion can be ripped away from the completed packaging, which may have a premium item 12 therein. By ripping the perforated portion 62 out of the packaging, the premium item can be removed or released from the packaging 10. The perforated portion may instead or additionally be provided on the third layers 18.

The perforated portion 62 is substantially rectangular with rounded corners, and may be similar in size to a playing card. Upon removal, it can function as a premium item or collectable item itself; it may be printed on both sides.

Figure 9:
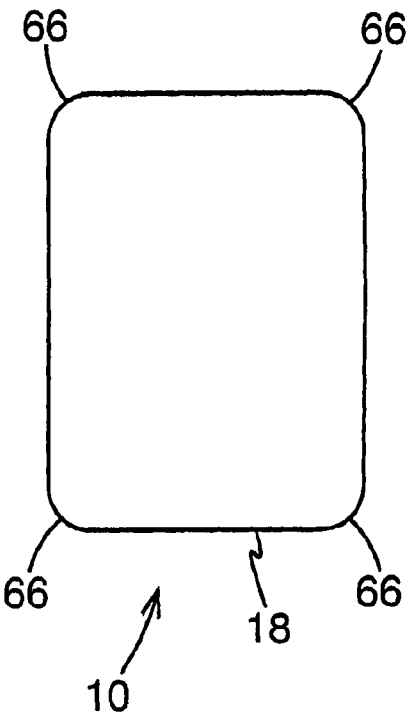
FIGS. 8 and 9 show another embodiment of the present invention, from the front and back, respectively.
Figure 8:
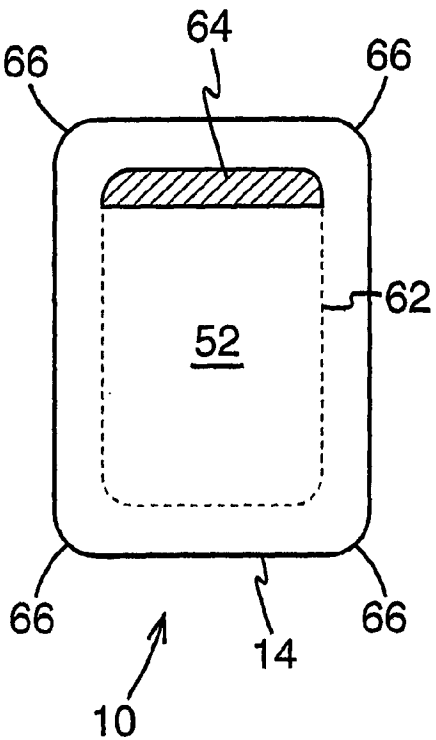

Referring finally to FIGS. 8 and 9, one further possible embodiment is illustrated. In this embodiment, there is no snap-apart element. Further, the device is sealed at both ends and down both sides. This embodiment of packaging is substantially rectangular with rounded corners 66.

An aperture 64 is cut into the first layer 14 to define a letter-box opening for accessing the void 52 inside the packaging 10. Additionally, a perforated portion 62, as in the embodiment of FIGS. 6 and 7, is provided. This defines a portion that can be removed from the first layer to access a premium (not shown) inside the packaging 10.

The aperture 64 has a symmetrical, generally trapezium-like shape. The ends, however, are curved or rounded. The perforated portion 62 is defined by the long side of the aperture 64 and three perforated sides. It is rectangular and has square corners. The aperture 64 is substantially more wide than it is high.

FIG. 9 shows the back or third layer 18 of this packaging 10. No cut outs or perforations are provided therein. However, as a variation of this final embodiment, the aperture 64 and perforated portion 62 may be cut into the third layer instead of or in addition to the first layer.

The second layer, which is not shown, is substantially as previously described. It has a removed portion to define a void within the packaging 10.

A premium item can be inserted manually into the void 52 in the packaging 10 through the aperture 64. The aperture, being out of plane from the void, although allowing insertion of a premium item (it will bend slightly), will not allow the premium item to fall out of the void without some persuasion.

In order to access a premium item within the packaging after insertion thereof through the aperture, the perforated portion 62 can be ripped from the first layer 14. The removed portion could itself then form a collectable trading card or some other consumer device such as a voucher, a postcard, a competition entry, etc.

In this or any of the other embodiments, the three layers can be laminated on top of one another. This can be done using separate sheets or a single blank. With a separate sheets in particular, each sheet can have a multiplicity of images or other information printed thereon. Further, by using multiple sheets, different materials can be used for any one or more of the sheets. For example, the second or middle layer could be made of a different material to the first and third layers. The first and third layers, being outer layers, would preferable be made of a high quality or attractive looking material. The central layer could be of a lesser quality material without devaluing the packaging since only its edge will be visible.

The present invention has been described above purely by way of example. Modifications in detail may be made to the invention as defined in the claims appended hereto.

The invention claimed is:

1. A packaging for a premium item comprising three layers of a material, each of an equal thickness, a first layer and a second layer being laminated to one another and having co-terminal peripheries, wherein the second layer has at least one portion thereof removed for defining a void inside the packaging for receiving the premium item, the third layer being laminated to the opposite side of the second layer to the first layer, wherein the packaging is a snap-apart packaging having partial cut lines to allow a first section of the packaging to be snapped away from a second section of the packaging to provide access to the void.

2. The packaging of claim 1, wherein the third layer has a co-terminal periphery to the first and second layers.

3. The packaging of claim 1, wherein the materials are food-safe materials.

4. The packaging of claim 1, wherein the removed portion is a central portion.

5. The packaging of claim 1, wherein the partial cut lines extend across the width of the packaging.

6. The packaging of claim 1, wherein a premium item is sealed within the void of the packaging.

7. The packaging of claim 1, wherein a section of the first or the third layer is not initially laminated to the second layer, the section defining a foldable flap.

8. The packaging of claim 7, wherein the foldable flap is bounded by a fold line extending across the width of the packaging.

9. The packaging of claim 1 wherein cuts for defining a snap-apart section are provided by two co-planar outer cuts, in or immediately adjacent to side edges of the packaging, the cuts extending through the three layers of the packaging, and a third cut, just in the first and third layers substantially bridging the gap between the two outer cuts.

10. The packaging of claim 9, wherein the cuts are perforations.

11. The packaging of claim 1, wherein the first or the third layer comprises a wall of a cardboard packaging, the first and second layers being attached to an inside of the wall of the cardboard packaging to form the packaging within the cardboard packaging.

12. The packaging of claim 1, wherein the second layer has a gap provided in one of its edge portions extending from the edge to the removed portion.

13. The packaging of claim 12, wherein the gap is tapered.

14. The packaging of claim 1, wherein the first or the third layer comprises at least one perforated portion that overlies the removed portion of the second layer.

15. The packaging of claim 14, wherein the perforated portion is printed.

16. The packaging of claim 1, wherein the first or third layer has a thumb-sized cut-out provided in an edge thereof.

17. The packaging of claim 1, wherein the first or third layer has an aperture provided therein for accessing the void.

18. A blank for forming a snap-apart packaging for a premium item, the packaging having three layers of a material, each of an equal thickness, a first layer and a second layer being laminated to one another and having co-terminate peripheries the blank being of substantially constant thickness and pre-cut with an aperture in a portion thereof corresponding to the second layer, for defining a void inside the packaging for receiving the premium item and wherein the blank has partial cut lines therein to allow a first section of the packaging, once formed from the blank, to be snapped away from a second section of the packaging to provide access to the void.

* * * * *